United States Patent [19]

Brewer

[11] Patent Number: 4,502,527

[45] Date of Patent: Mar. 5, 1985

[54] SINGLE SHOP CONTINUOUS CASTING FACILITY

[75] Inventor: Bruce L. Brewer, Alliance, Ohio

[73] Assignee: AMCA International Corporation, N.H.

[21] Appl. No.: 490,465

[22] Filed: May 2, 1983

Related U.S. Application Data

[63] Continuation of Ser. No. 234,704, Feb. 17, 1981, abandoned.

[51] Int. Cl.[3] ..... B22D 11/00

[52] U.S. Cl. ..... 164/418; 164/412; 212/220; 212/226

[58] Field of Search ..... 164/76.1, 322, 337, 164/418, 417, 459, 437, 477, 488, 412; 212/226, 217, 220; 254/290, 291, 292, 295

[56] References Cited

U.S. PATENT DOCUMENTS

| | | | |
|---|---|---|---|
| 1,034,970 | 8/1912 | Brown, Jr. | 164/335 |
| 1,148,323 | 7/1915 | Kendall | 254/292 |
| 1,727,206 | 9/1929 | Kendall | 254/290 |
| 2,271,428 | 1/1942 | Harry | 212/217 |

*Primary Examiner*—Nicholas P. Godici
*Assistant Examiner*—Maureen Weikert
*Attorney, Agent, or Firm*—Maky, Renner, Otto & Boisselle

[57] ABSTRACT

A single shop continuous casting facility is disclosed that comprises furnaces 10 and 10*a* for producing hot metal, continuous casters 12 and 12*a* for forming continuous lengths of solidified metal, and a rotating bridge crane 14 for transporting ladles 52 of hot metal from the pouring stands of said furnaces to the casting stands of said casters, the pouring stands of said furnaces and the casting stands of said casters being disposed within the arcuate area serviced by crane 14.

13 Claims, 2 Drawing Figures

SINGLE SHOP CONTINUOUS CASTING FACILITY

This is a continuation of application Ser. No. 234,704, filed Feb. 17, 1981 abandoned.

TECHNICAL FIELD

This invention relates generally to continuous casting facilities and, more particularly, to arrangements of furnaces, cranes and continuous casters adapted to improve the convenience and efficiency of operation of such facilities. Specifically, the invention relates to a single shop casting facility with a rotating bridge crane adapted for transporting hot metal transfer ladles from one or more steel-making furnaces to one or more continuous casters.

BACKGROUND OF THE INVENTION

Present day continuous casting facilities generally comprise two adjoining shops, one of which is known as a ladle shop and the other which is known as a casting shop. Each shop is provided with its own traveling crane, each operating along its own pair of tracks, with the pairs of tracks extending parallel to each other. The pairs of tracks are spaced apart slightly to permit each of the two cranes to travel independently within its own shop without interfering with the travel of the other within its shop. The two shops are separated from each other, not necessarily physically as by a barrier such as a wall, but functionally by a space between the pairs of crane tracks which define a separation zone between the shops. All of the functions of the ladle movement and handling are performed in the ladle shop by the ladle shop crane, while all the functions incident to the actual casting operation are performed in the casting shop by the casting shop crane.

Another commonly used design for continuous casting facilities involves the use of three adjoining shops. One of these shops is a furnace shop, the second is a hot metal handling shop and the third is a casting shop. Each of these shops is provided with its own traveling crane, each operating along its own pair of tracks, with the pairs of tracks extending parallel to each other. The pairs of tracks are spaced apart slightly to permit each of the three cranes to travel independently within its own shop without interfering with the travel of the other cranes. The three shops are separated from each other at least functionally by the space between the pairs of crane tracks which define separation zones between the shops.

Whether two shops or three shops are employed, cross transfer equipment is required to transport ladles containing hot metal from one shop to the next. A type of cross transfer equipment that is commonly used is a ladle rotator which consists of a ladle turret having a vertical shaft located between shops carrying two oppositely disposed arms pivotally mounted on the shaft with one arm extending into the ladle shop (two-shop facility) or the hot metal handling shop (three-shop facility) ready to receive a new full ladle, and the other arm extending into the casting shop to support a ladle in position for pouring into the tundish of the caster. When the ladle over the tundish is empty, the arms are rotated 180° to bring a full ladle from the ladle shop or hot metal handling shop into the casting shop and to bring the empty ladle into the ladle shop or hot metal handling shop. Another type of cross-transfer equipment utilizes ladle-transfer cars which move, for example on rails, and transport full or empty ladles from one shop to the next.

The cranes and cross-transfer equipment utilized with present day continuous casting facilities generally are required to handle hot metal transfer ladles weighing in the range of about 200 to about 400 tons and, consequently, are by necessity massive structures that are costly to install, maintain and operate. It would be advantageous to reduce the number of cranes required for servicing a continuous casting facility and to minimize or eliminate the necessity of using cross-transfer equipment.

SUMMARY OF THE INVENTION

Single shop continuous casting facilities of the type hereinafter described are designed in such a manner so as to require the use of only one crane for servicing the furnace(s) and the continuous casting line(s) of the facility and thereby eliminates the necessity for utilizing a plurality of separate cranes and cross-transfer equipment such as ladle rotators and ladle-transfer cars. Broadly stated, the invention contemplates the provision of a single shop continuous casting facility comprising furnace means for producing hot metal, said furnace means including seating means for positioning ladles for receiving hot metal from said furnace means, continuous casting means for forming soldified metal, said casting means including seating means for positioning ladles containing hot metal to permit the transfer of hot metal from said ladles to said casting means, and a rotating bridge crane for transporting ladles of hot metal from said seating means of said furnace means to said seating means of said caster means, said seating means of said furnace means and said seating means of said caster means being disposed within the arcuate area serviced by said crane. In a preferred embodiment, said furnace means comprises two electric-arc furnaces and said casting means comprises two parallel spaced continuous casting lines.

Advantageously, the rotating bridge crane utilized in the continuous casting facility of the present invention contemplates the provision of an elongated horizontal substantially rectangular bridge, an arcuate track, an elongated vertical support member disposed in spaced radial relationship to said track, said bridge including wheel means depending from one end of said bridge, said wheel means being adapted for travel along said track, the end of said bridge opposite said one end being rotatably mounted on said support member, means for driving said wheel means, hoisting means mounted on said bridge, and a pair of ladle hooks suspended from said hoisting means, said ladle hooks being adapted for attachment to the trunnions of hot metal transfer ladle, said hoisting means being adapted for lifting and lowering said ladles. In a preferred embodiment, said hoisting means comprises a trolley mounted on said bridge adapted for horizontal radial travel along said bridge. In a particularly advantageous embodiment, said track is circular.

BRIEF DESCRIPTION OF THE DRAWINGS

In the annexed drawings, like references indicate like parts or features.

DETAILED DESCRIPTION OF THE PREFERRED EMBODIMENT

Figure 1:
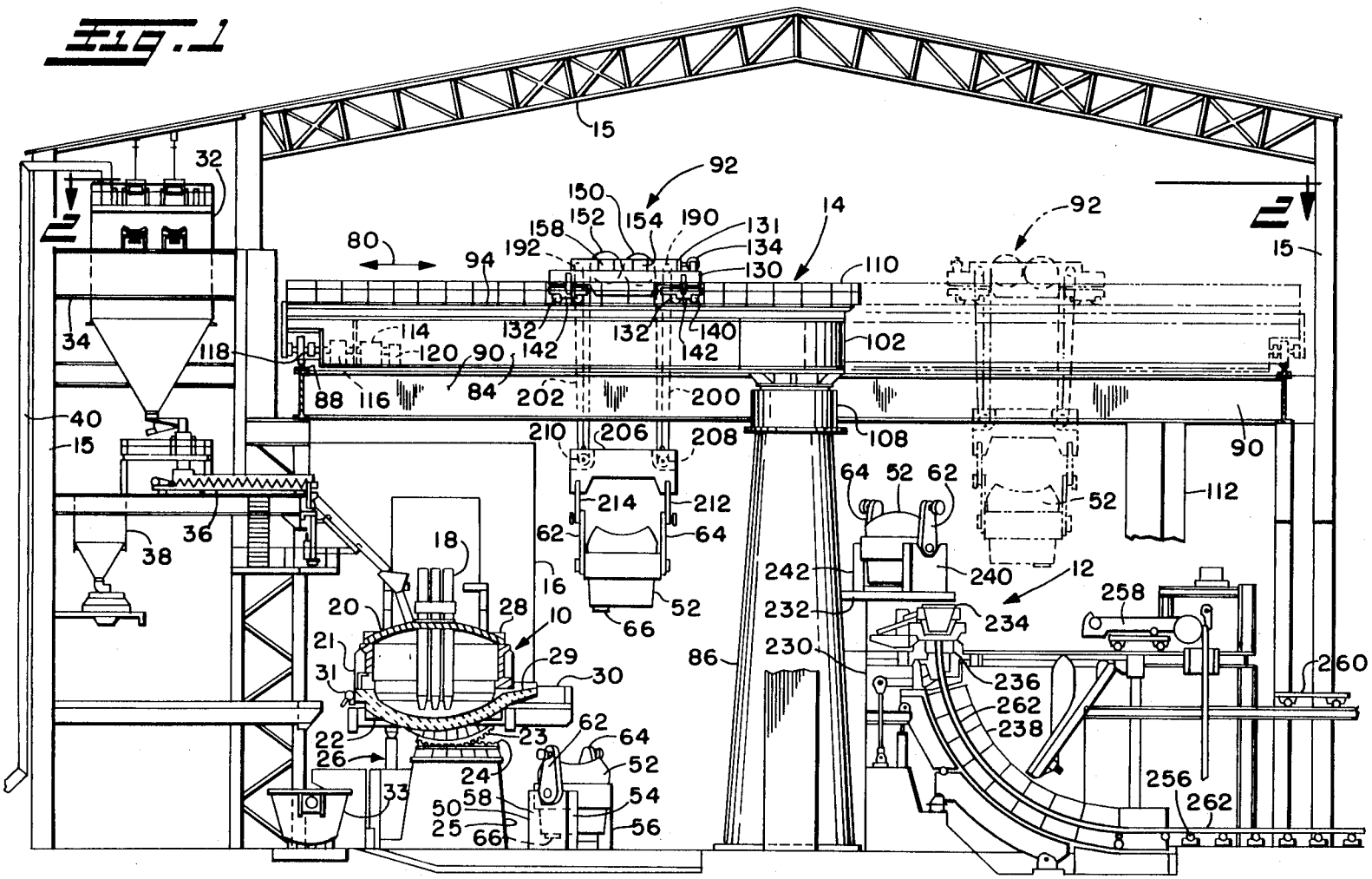
FIG. 1 is an elevational view of a continuous casting facility embodying the present invention in a particular form, with the rotating bridge crane of said facility being shown in phantom to illustrate an operative position of the crane.
Figure 2:
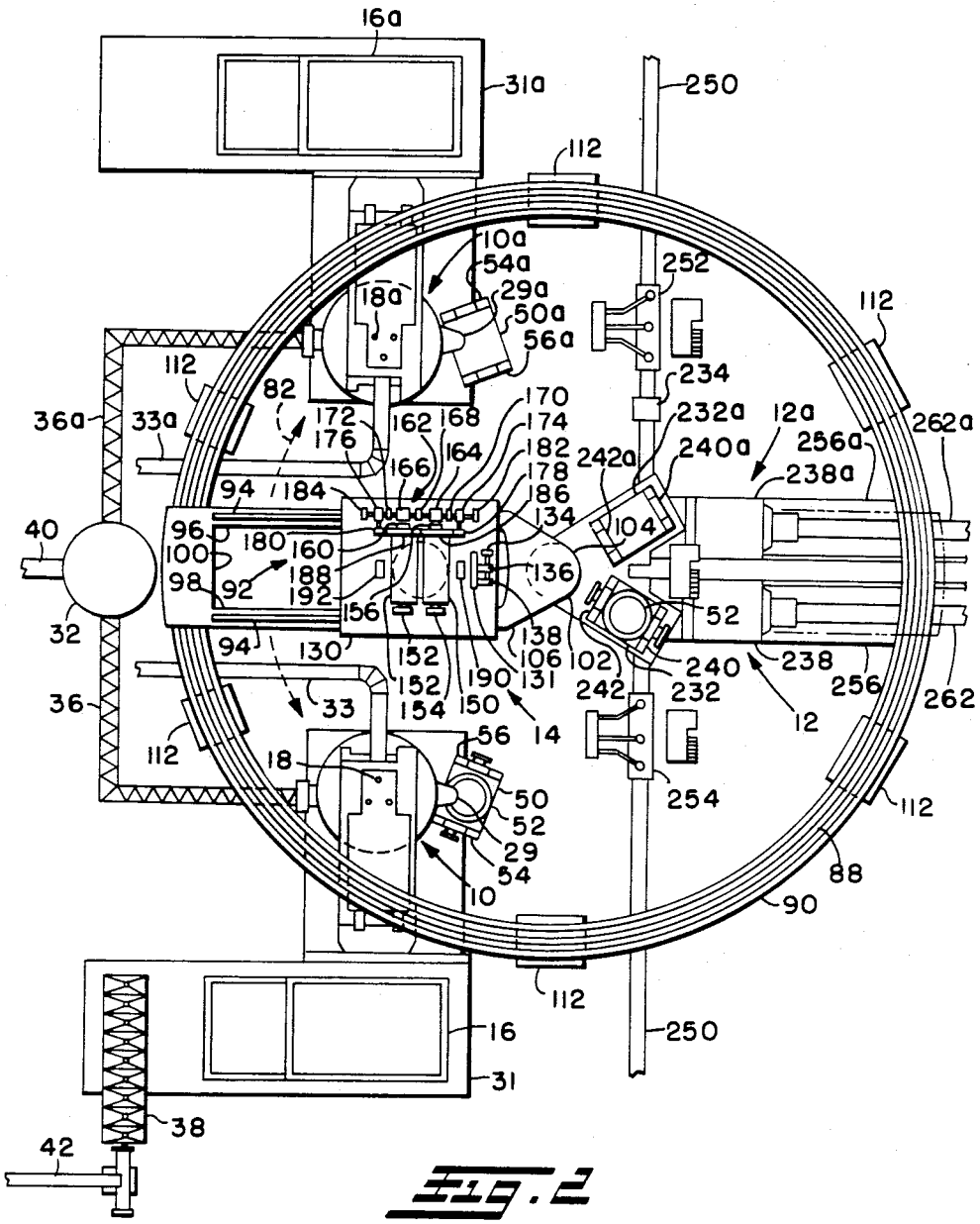
FIG. 2 is a reduced plan view of the continuous casting facility illustrated in FIG. 1 taken along the line 2—2 of FIG. 1.

The continuous casting facility of the present invention, in the embodiment illustrated in FIGS. 1 and 2, comprises a pair of electric arc steel melting furnaces indicated generally by the reference numerals 10 and 10*a*, a pair of parallel spaced semi-horizontal continuous casting lines indicated generally by the reference numerals 12 and 12*a* and a rotating bridge crane indicated generally by the reference numeral 14 which is adapted for transporting hot metal transfer ladles from the pouring stand of either of said furnaces to the casting stand of either of said continuous casting lines, all as hereinafter further explained. Furnaces 10 and 10*a*, casters 12 and 12*a* and crane 14 are housed within building structure 15. In the illustrated embodiment, parts or features identified with a numeral followed by the letter suffix "a" are identical to the part or feature identified with the identical numeral without a letter suffix; accordingly, for convenience, the description hereinafter shall refer only to the part or feature identified by the numeral, such description also being applicable to the part or feature identified by the identical numeral followed by the letter suffix "a".

In the illustrated embodiment furnaces 10 and 10*a* are identical in construction, design and operation and, accordingly, it is only necessary to describe the construction, design and operation of furnace 10, such description also being applicable to furnace 10*a*. Furnace 10 is a direct-arc, basic lined furnace with a non-conducting bottom that is primarily a scrap melting furnace, although iron in the form of molten blast furnace metal and direct reduced materials (e.g., pre-reduced pellets) can be used for the charge. A three-phase transformer 16, equipped for varying the secondary voltage, is used to supply energy to furnace 10 from an electrical power system over a suitable range of power levels that can be ascertained by one of ordinary skill in the art. Cylindrical solid graphite electrodes 18, are suspended from above the shell 21 of furnace 10 and extend down through ports in the roof 20 of furnace 10. Electrodes 18 are used to conduct electric current inside the shell 21 of furnace 10. Current passes from one electrode through an arc to the metal charge, then through the metal charge and through an arc to an adjacent electrode. Heat developed by the electrical resistance of the metal charge is added to the heat radiated from the arcs. The furnace shell 21 is cylindrical in shape with a spherically dished bottom plate 22. The shell 21 is of the cage type of construction with loose sidewall plates to minimize shell distortion and possible rupture resulting from thermal expansion and contraction and to facilitate repairs to damage from sidewall burn-throughs. The shell structure preferably consists of a heavy welded structural steel cage of vertical buckstays and horizontal circumferential yokes, lined with rolled steel plates. Below the sill line, the lining plate is welded to and made an integral part of the structure. The dished and flanged bottom plate 22 is hung from the hearth lining plate through a circumferential bolted connection to permit the bottom plate to expand and contract freely with temperature variations and thereby minimize sheer and bending stresses from the static loads imposed by the metal bath and refractory lining and the dynamic loading from the top-charging operation (described below). Above the hearth line, the lining is divided into sectors to span between buckstays and is loosely fastened to the cage structure, permitting these plates to expand and contract freely.

The shell 21 is mounted on parallel spaced toothed rockers 23 and rails 24 which permit forward and backward tilting of furnace 10. Rails 24 are mounted on support structure 25. The radius of rocker curvature is selected in relation to the center of gravity of the complete mass to be tilted, i.e., furnace structure, electrodes, refractory lining, metal charge, etc. so that the tendency for the furnace to overturn at any degree of tilt under normal operation conditions is minimized. For example, a tilt of about 45° forward for tapping and 15° backward for deslagging is acceptable. The angle of forward tilt is generally equal to or slightly greater than the angle of the hearth bank to insure complete draining of the hearth. The maximum angle of hearth bank in turn is dictated by the maximum angle of repose of commercially available and economically usable refractory fettling materials. The greater the bank angle, the larger the hearth capacity for given depth, but 45° under most circumstances is a practical limit. The furnace is tilted by a dual rack and pinion mechanism indicated generally by the reference numeral 26 attached to the rockers and driven by a variable speed motor through a speed reducer (not shown). Electrical limit switches and mechanical stops (not shown) are provided to limit the tilting motion within the design range.

The shell bottom 22 preferably is laid first with a layer of clay, magnesite or silica brick. The subhearth preferably has a stadium-type construction for an inverted arch-type construction. Openings are provided inside of the shell structure for the taphole, rear slagging and working door and a side door as an aid in refining the heat and fettling the massed wall. Alternatively, the side door opening can be omitted to reduce heat loss and air infiltration. Instead of the side wall door opening, covered ports can be provided to facilitate fettling and oxygen blowing. Ports also can be provided for lime and carbon injection lances. All shell openings are structurally reinforced and water cooled where necessary to maintain shell integrity. The design and construction of such openings are known to those of ordinary skill in the art and, consequently, need not be described further.

The furnace roof 20 includes a welded steel, water cooled, circular ring 28 forming a circumferential retainer for a dome-shaped refractory structure. Refractories for the roofing lining are generally constituted of high alumina brick, with high alumina rammed or castable materials for the center section around the electrodes 18. The steel roof ring 28 is a hollow right triangle in cross-section, with the hypotenuse forming the interior side of the ring and serving as a skewback for the refractory dome. Water is circulated through the interior of the hollow ring for cooling of both the ring and the adjacent roof refractories. The ring is slightly larger in outside diameter than the inside diameter of the furnace shell so that the weight of the roof is carried on the steel shell structure rather than on the furnace sidewall refractories. The ring is equipped with lifting and stacking lugs and is reinforced to resist warping and distortion from lifting stresses. Retainers are provided on the top of the shell structure to prevent the roof from sliding when the furnace is tilted. It is preferable to have at least two roofs for each furnace so that at the end of a campaign, the old roof can be replaced with a new one with a minimum of furnace down time. Flue 33 communicates with the interior of furnace 10 through a port in roof 20 and provides for the exhaust of flue gases through appropriate filters and separators in a manner to conform with required government regulations.

Attached to the rockers 23 is platform structure 30 which serves as a floor closure for operating and maintenance work and supports a superstructure together with the mechanisms for positioning the electrodes and raising and swinging the roof. For clarification of illustration, the superstructure and mechanisms for positioning the electrodes, and raising and swinging the roof are not shown in the drawings. The superstructure generally is located adjacent to the electrical equipment vault 31 and consists of a movable structure mounted on wheels running on a curved track on the platform structure 30. Incorporated with the structure are two roof lift arms which are cantilevered out over the shell 21 together with a platform interconnecting (a) the outboard ends of these arms and providing access to the electrode holders, (b) the side frame in which the electrode positioning masts operate, and (c) the machinery platform on which the electrode positioning, roof lift and swing machinery are mounted. The construction, design and operation of such roof removal mechanisms, and electrode holders and positioning mechanisms are discussed in "The Making, Shaping and Treating of Steel", edited by Herald E. McGannon, Ninth Edition, at pages 559–563, which is incorporated herein by reference.

Furnace 10 is charged by swinging the roof 20 sideways and top charging the furnace utilizing crane 14. The entire charge can be placed in the furnace by drop-bottom scrap bucket (not shown in the drawings). It is desirable to load the scrap bucket with a layer of light scrap on the bottom to provide some cushioning of the fall of the larger pieces of scrap. Scrap charges of 100 tons or more can be charged with one scrap bucket. Storage bin 32 which is mounted on structure member 34 of building structure 15 and communicates with furnace 10 through conveyor 36 is used for charging furnace 10 with iron ore pellets. Storage bin 38 which is also mounted on building structure 34 is used for storing alloying materials. The alloying materials are charged to furnace 10 when the roof 20 is swung open or through ports in roof 20 when the roof is closed. Alternatively, the alloying materials can be admixed with the scrap or iron ore pellets prior to charging furnace 10. Storage bins 32 and 38 are filled from the ground level by conveyors 40 and 42, respectively.

While direct arc-heating furnaces 10 and 10*a* have been disclosed in the illustrated embodiment of the casting facility of the present invention, it will be understood by those skilled in the art that any steel making furnace suitable for making hot metal for continuous casting that is known in the art can be utilized in accordance with the present invention. Such furnaces include, for example, basic open hearth furnaces, basic oxygen furnaces as well as other types of electric furnaces. Such electric furnaces include resistance furnaces, which utilize indirect, direct or induction heating, and indirect- and independent-arc furnaces, and combination direct arc and resistance furnaces. The design, construction and operation of each of these types of furnaces are well known to those skilled in the art and, consequently, need not be further described herein.

Pouring stand 50 is mounted on the floor of the casting facility adjacent to furnace 10 and provides a seat for hot metal transfer ladle 52. Pouring stand 50 has a pair of parallel spaced mounting brackets 54 and 56 each of which include seat members 58 and 60, respectively, (seat member 60 not being shown in the drawings). Seat members 58 and 60 are adapted for receiving and supporting trunnions 62 and 64 of ladle 52. Ladle 52 is entirely conventional and is suitable for transporting hot metal in any conventional continuous casting facility. Ladle 52 has a nozzle 66 on its underside which is closed while the ladle is being filled or transported and opened when it is desired to empty the contents of the ladle into the continuous caster. Each of the ladles of the illustrated embodiment are identical in design and construction. Ladle 52 has sufficient capacity for receiving the entire contents of furnace 10. When loaded with hot metal, ladle 52 has a weight in the range of, for example, about 200 tons to about 400 tons.

Crane 14 is a rotating bridge crane which has provision for hoisting movements as well as both rotational and radial horizontal movements, as indicated by directional arrows 80 and 82, so that the ladle being moved can be transported from any point within the arc covered by the movement of crane 14. Crane 14 comprises bridge 84, which is adapted to spanning the ground or floor area to be serviced by crane 14, and rotates about vertically elongated support column 86 along circular track 88 which is mounted on support structure 90, and a trolley which is indicated generally by the reference numeral 92 and is adapted for radial horizontal movement along tracks 94 which are mounted on bridge 84.

Bridge 84 is an elongated horizontal substantially rectangular frame comprising elongated horizontal parallel spaced girders 96 and 98 connected by end-tie 100 and pivotal frame member 102. Girders 96 and 98 are sufficiently elongated to traverse the ground or floor area to be serviced by crane 14. End-tie 100 is shorter than girders 96 and 98 but is sufficiently elongated to provide structural stability to crane 14 and to provide a sufficiently open area between girders 96 and 98 to allow for the movement and operation of trolley 92. Pivotal frame member 102 is rotatably mounted on support column 86 and comprises a cylindrically shaped pivot member with a vertically oriented center axis and a pair of horizontally projecting flange members 104 and 106 which are welded to girders 96 and 98, respectively. Rotate bearing assembly 108 is disposed between column 86 and frame member 102. Bearing assembly 108, which includes a plurality of rollers disposed between an inner circular race and an outer circular race (not shown in the drawings), permits the horizontal clockwise and counterclockwise rotation of bridge 84 relative to support column 86. Bearing assembly 108 is fixedly attached to column 86 and frame member 102 by bolting or welding. The centers of column 86, bearing assembly 108, and frame member 102 are preferably open to permit the running of electrical lines from a power source to bridge 84 and trolley 92. Bridge 84 has a walkway 110 extending over its entire length to provide for the servicing, repair and oiling of the bridge and trolley. Track 88 is mounted on circular support member 90 which is mounted on elongated vertical support columns 112. Support member 90 preferably includes a walkway for servicing track 88 and bridge 84. Alternatively, track 88 or support member 90 can be mounted on an existing building structure.

The rotational movement of bridge 84 along arcuate track 88 is accomplished by the operation of electric motor 114 which is attached to girder 98. Motor 114 rotatably engages gear reducer 116 which drives wheels 118. Gear reducer 116 is also attached to girder 98. Electrically operated brake 120 is attached to girder 98 and is aligned with and attached to motor 114. Brake 120 is used to reduce or stop the rotation of the armature of motor 114. Wheels 118 comprise a set of eight wheels rotatably mounted for travel along track 88. Preferably, two of the eight wheels are actually driven by motor 114, the others follow the driven wheels and provide the bridge with support. Wheels 118 are flangeless wheels. Alternatively, a second motor-gear reducer-brake assembly similar to the foregoing can be mounted on girder 96 for driving one or two additional wheels 118; the operation of this second assembly is synchronized with the first assembly.

Trolley 92 comprises a substantially rectangular frame 130 which is mounted on wheels 132 and 140 and adapted for horizontal movement along tracks 94 in the directions indicated by directional arrow 80. Trolley 92 is sufficiently horizontally elongated to span the opening between girders 96 and 98, each of the girders 96 and 98 having one of the tracks 94 mounted on it. Trolley 92 is driven along tracks 94 by electric motor 134 which is mounted on frame member 131 which is welded to and projects upwardly from frame 130. Motor 134 is rotatably attached to gear reducer 136. Gear reducer 136 and electrically operated brake 138 are also mounted on frame member 131. Brake 138 engages the armature of motor 134. Wheels 132 and 140 are rotatably attached to wheel housings 142 which are pinned, bolted or welded to the underside of frame 130. Wheels 140 are rotatably attached to gear reducer 136 by a horizontally elongated drive shaft (not shown). The rotation of the armature of motor 134 transmits rotational motion to gear reducer 136 which in turn causes the drive shaft to rotate and drive wheels 140. The rotation of the armature in one direction drives trolley 92 from left to right along bridge 84 (FIG. 1), while the rotation of the armature in the opposite direction drives the trolley from right to left. The movement of trolley 92 is slowed or stopped by the activation of brake 138. The movement of trolley 92 beyond the edges of bridge 84 is prevented by bumper stops (not shown) which are bolted or welded to girders 96 and 98.

Lifting barrels 150 and 152 are rotatably mounted on pillow blocks 154 and 156, and 158 and 160, respectively, which are bolted to and project upwardly from frame 130. The center axes of barrels 150 and 152 are disposed horizontally in spaced parallel relationship to each other. Barrels 150 and 152 are rotated by a drive assembly which is indicated generally by the reference numeral 162. Drive assembly 162 comprises electric motors 164 and 166 which are mounted on frame 130. Motors 164 and 166 are connected to each other by coupling 168. The connection at coupling 168 mechanically synchronizes motors 164 and 166 to insure that the rate of rotation of such motors are equal. Motors 164 and 166 are connected to electrically operated brakes 170 and 172, respectively. Drive shafts, which project from and are rotated by motors 164 and 166, engage brakes 170 and 172 and worm reducers 174 and 176, respectively. Worm reducers 174 and 176 are connected to pinion gears 178 and 180, respectively. Pinion gears 178 and 180 are rotatably mounted on frame 130. Shafts projecting from worm reducers 174 and 176 engage electrically operated brakes 182 and 184, respectively, which are mounted on frame 130. Gears 178 and 180 rotatably engage gears 186 and 188 which are mounted on barrels 150 and 152, respectively. Gears 186 and 188 are operated with zero backlash, respectively; the rotation of gears 186 and 188 is timed so that the gear teeth of one gear do not touch the gear teeth of the other during normal operation. In the event, however, that one or more components in the drive assembly of either barrel 150 or 152 should fail, the gear teeth of gears 186 and 188 would engage each other so that the functioning parts of drive assembly 162 would in effect drive both barrels 150 and 152 to prevent an unbalancing of the load being carried by the crane. Barrel 150 rotates in a clockwise direction when barrel 152 rotates in counterclockwise direction, and vice versa. Upper sheaves 190 and 192 are rotatably mounted on frame 130 with their axes of rotation parallel to the axes of rotation of barrels 150 and 152. Each brake 170, 172, 182 and 184 is mounted on frame 130 and is designed to reduce or stop the rotation of barrels 150 and 152 and, optionally, lock the barrels in place during the transport of crane loads. Thus, each motor 164 and 166 employs two brakes to provide an added measure of safety. While one brake on each motor is adequate under various advantageous conditions, two are preferred, particularly for transporting hot metal ladles.

Depending from barrel 150 and upper sheave 190 are ropefalls 200. Likewise, depending from barrel 152 and upper sheave 192 are ropefalls 202. Ropefalls 200 and 202 are disposed between girders 96 and 98. Suspended by ropefalls 202 and 204 is lifting beam 206. The ropefalls, lifting barrels and upper sheaves are arranged so that the load hoisted and transported by trolley 92 is centrally and evenly distributed over girders 96 and 98. Each ropefall 200 and 202 preferably comprises fourteen wire ropes, seven of the ropes being coiled in right-handed grooves in each of the barrels 150 and 152, and seven being coiled in lefthanded grooves in each of the respective barrels. Additional wire ropes or fewer wire ropes can be utilized with each ropefall, the number and design of such wire ropes being dependent upon the anticipated loads to be hoisted. Rotatably attached to lifting beam 206 are hoisting sheaves 208 and 210 which are attached to ropefalls 200 and 202, respectively. Depending from lifting beam 206 are parallel spaced ladle hooks 212 and 214 which are pivotally attached to beam 206 and are adapted for attachment to trunnions 62 and 64 of ladle 52. Ropes 200 drop from barrel 150 to hoising sheave 208, wrap around sheave 208, extend upwardly to sheave 190, drop to sheave 208, continue for the necessary number of falls and ultimately return to beam 206 where they dead end. Similarly, ropes 202 drop from barrel 152 to hoisting sheave 210, wrap around sheave 210, extend upwardly to sheave 192, wrap around sheave 192, drop to sheave 210, continue for the necessary number of falls and ultimately return to beam 206 where they dead end. The dead ends of ropes 200 and 202 are attached to lifting beam 206 with an equalizer bar (not shown). The winding or unwinding of ropes 200 and 202 on barrels 150 and 152, respectively, result in a consequent shortening or lengthing of ropefalls 200 and 202 to lift or lower lifting beam 206.

Continuous casters 12 and 12*a* are identical in construction, design and operation and, accordingly, it is only necessary to describe the construction, design and operation of caster 12, such description also being applicable to caster 12*a*. Continuous caster 12 is a semi-horizontal continuous caster that is entirely conventional and is adapted for producing shapes corresponding to all of the basic semi-finished sections such as, for example, squares from two-inch by two-inch to fourteen-inch by fourteen-inch, and slabs up to twelve-inches by eighty-four inches as well as rounds. A casting tower 230, which is mounted on the floor of the casting facility, is provided to support casting stand 232, tundish 234, mold 236, and curved cooling chamber 238. Casting stand 232 is a rectangular frame structure with a center opening and a pair of parallel spaced seat members 240 and 242 which are adapted for receiving and supporting trunnions 62 and 64 of ladle 52. Casting stand 232 is constructed in such a manner so as to support ladle 52 which when filled with hot metal has a weight in the range of, for example, about 200 tons to about 400 tons. Casting stand 232 has an opening to permit the flow of hot metal through nozzle 66 of ladle 52 into tundish 234. Tundish 234 is a rectangular trough lined with fire clay refractories that has a pair of refractory nozzles in its base. Tundish 234 is movably mountd on track 250. Preheat stations 252 and 254 are provided for preheating the tundish. Mold 236 is water cooled and has an opening of the desired shape of the final casted product. Mold 236 is supported by a frame member which is mounted on tower 230 and is designed to permit rapid mold changes. Cooling chamber 238 has a sufficient number of water spray headers and a curved guide rack in its interior to provide for the desired cooling and bending of the strand of metal 262 produced from mold 236. Conveyor 256 transports the strand of metal 262 from cooling chamber 236 to a cutting station (not shown in the drawings) which can be of any conventional design (e.g., a traveling torch cut-off). Repair trolleys 258 and 260 are provided for removing or replacing the various components of casting line 12. While semi-horizontal continuous casting lines 12 and 12*a* have been disclosed in the illustrated embodiment, it will be understood by those skilled in the art that any conventional continuous casting line (e.g., vertical caster, vertical plus bending caster, etc.) suitable for making continuous strands of molded metal can be utilized in accordance with the present invention.

In operation, electrodes 18 are raised and furnace roof 28 is swung open to permit the top charging of furnace 10. Furnace 10 is charged with the desired level of scrap metal, iron ore pellets and alloying materials. The charging of furnace 10 with scrap metal is accomplished by hoisting a dropbottom scrap bucket (not shown in the drawings) with crane 14 from a transfer car to a point over the open furnace 10 and then dropping the contents of the charging bucket into the furnace. Iron ore pellets are charged to the furnace from storage bin 32 through conveyor 36. Alloying materials are charged either directly to the furnace or with the scrap or iron ore pellets. Once the desired charge has been inserted into furnace 10, roof 28 and electrodes 18 are replaced and the furnace is heated by passing current through the electrodes. When the charge reaches a desired molten state, the furnace is tilted forward on rockers 23 and rails 24 to permit the pouring of the contents of furnace 10 through tapping spout 29 into ladle 52 which is positioned on pouring stand 50. If deslagging is required furnace 10 is tilted backward on rockers 23 and rails 24 (prior to filling ladle 52) to permit the slag to empty into slag pot 33 through spout 31. When the ladle 52 is filled, it is ready for removal to the caster 12 which is accomplished by the utilization of crane 14. Bridge 84 is rotated about column 86 along tracks 88, and trolley 92 is moved along tracks 94 until ladle hooks 212 and 214 are suspended over ladle 52. Ladle hooks 212 and 214 are lowered by the activation of drive assembly 162 to rotate barrels 150 and 152 until ladle hooks 212 and 214 are in sufficiently close proximity to trunnions 64 and 62 for attachment. Ladle hooks 212 and 214 are then attached to trunnions 64 and 62. Ladle 52 is hoisted by the rotation of barrels 150 and 152 which move lifting beam 206, and consquently, ladle hooks 212 and 214 upwardly. Ladle 52 is transported in its upright position. With the upward hoisting of ladle 52, bridge 84 is rotated about column 86 along track 88 and trolley 92 is moved along track 94 until ladle 52 is suspended over casting stand 232. Upon reaching a point on a substantially vertical line over casting stand 232, ladle 52 is lowered by the rotation of barrels 150 and 152 until it is placed down on casting stand 232. The angular orientation of pouring stand 50 and casting stand 232 is set to accommodate the movement of crane 14 and, in particular, the orientation of ladle hooks 212 and 214. Upon being placed down on bracket 232, ladle 52 is in position for its contents to be emptied into tundish 234. Nozzle 66 is opened and hot metal flows into tundish 234. From tundish 234, hot metal flows through mold 236 from which continuous strand 262 of metal emerges. Strand 262 descends through cooling chamber 238 wherein it is cooled and bent to change direction and then is transported to a cutting station along conveyor 256.

After placing ladle 52 on stand 232, crane 14 is ready for servicing furnace 10*a* and continuous caster 12*a*. Furnace 10*a* and caster 12*a*, being identical in design and construction to furnace 10 and caster 12, respectively, are operated in the same manner and serviced in the same manner by crane 14 as furnace 10 and caster 12. An advantage of employing two separate furnaces and two separate casting lines, i.e., furnaces 10 and 10*a* and casters 12 and 12*a*, is that different alloys of metals can be produced in the casting facility simultaneously. Alternatively, one large furnace could be used for servicing both casting lines or a single casting line, or two small furnaces could be employed for servicing one casting line.

An advantage of the single shop casting facility of the present invention is that the elimination of a hot metal handling bay commonly used in present day facilities is permitted. The requirements for the use of a ladle rotator, ladle transfer cars, a separate tundish service crane, and repair hoists used in repairing either the furnaces or casters can be avoided due to the arrangement of the furnace, caster and rotating bridge crane used in the casting facility of the present invention. The casting facility of the present invention permits the use of a smaller plant area to accomplish the furnace and casting operations and thereby provides for added versatility and reduced costs in building and equipment utilization. Additionally, since fewer pieces of equipment are required, fewer equipment operators are required and, consequently, labor costs savings can be realized.

Although the invention has been explained in relation to its preferred embodiments, it is to be understood that various modifications thereof will become apparent to those skilled in the art upon reading this specification. Therefore, it is to be understood that the invention disclosed herein is intended to cover such modifications as fall within the scope of the appended claims.

I claim:

1. A single shop continuous casting facility comprising furnace means for producing hot metal, said furnace means including seating means for positioning ladles for receiving hot metal from said furnace means, continuous casting means for forming solidified metal, said casting means including seating means for positioning ladles containing hot metal to permit the transfer of hot metal from said ladle to said casting means, and a rotating bridge crane for transporting ladles of hot metal from said seating means of said furnace means to said seating means of said casting means, said seating means of said furnace means and said seating means of said casting means being disposed within the arcuate area serviced by said crane, said crane comprising: vertical support means; an arcuate track mounted overhead on a building structure or vertically elongated support members; a bridge extending horizontally between an upper end portion of said vertical support means and said track; pivot means connected between said vertical support means and an inner end portion of said bridge for rotatably supporting said bridge on said vertical support means; drive means connected with an outer end portion of said bridge for engaging said track and causing said bridge to rotate in a horizontal plane about said vertical support means as said outer end portion of said bridge moves on said track; hoisting means mounted on said bridge, said hoisting means including first and second lifting barrels, first drive means for rotating said first lifting barrel, second drive means for rotating said second lifting barrel, a first gear connected to said first barrel, said first gear being driven by said first drive means in a first direction, a second gear connected to said second barrel, said second gear being driven by said second drive means in a second direction, said first and second gears being disposed with the teeth of one fitting between the teeth of the other and being free of load transmitting contact with each other during normal operation of said first and second drive mean, one of said gears driving the other of said gears upon failure of one of said first or said second drive means; and a pair of ladle hooks suspended from said hoisting means, said ladle hooks being adapted for attachment to the trunnions of a hot metal transfer ladle.

2. The facility of claim 1 wherein said furnace means comprises an electric-arc furnace and said seating means of said furnace means comprises a pouring stand disposed within the arcuate area serviced by said crane.

3. The facility of claim 1 wherein said furnace means comprises a pair of electric-arc furnaces and said seating means of said furnace means comprises a pair of pouring stands, each of said pouring stands being disposed within the arcuate area serviced by said crane.

4. The facility of claim 1 wherein said casting means comprises a semi-horizontal casting line and said seating means of said casting means comprises a casting stand disposed within the arcuate area serviced by said crane.

5. The facility of claim 1 wherein said casting means comprises two parallel semi-horizontal casting lines and said seating means for said casting means comprises a pair of casting stands disposed within the arcuate area serviced by said crane.

6. The facility of claim 1 wherein said furance means comprises a pair of electric-arc furnaces and said casting means comprises a pair of parallel spaced semi-horizontal casting lines.

7. The facility of claim 1 wherein said hoisting means comprises a trolley mounted on said bridge and adapted for horizontal travel along said bridge.

8. The facility of claim 7 wherein said trolley comprises a substantially rectangular frame, wheel means for supporting said frame, said wheel means adapted for travel along parallel spaced tracks mounted on said bridge and means for driving said wheel means.

9. The facility of claim 1 with a plurality of ropefalls depending from said lifting barrels.

10. The facility of claim 9 with a ladle lifting beam suspended by said ropefalls.

11. The facility of claim 10 wherein said ladle lifting beam comprises a horizontally elongated member suspended by said ropefalls, said ladle hooks depending from said elongated member.

12. The facility of claim 1 wherein said bridge is a horizontally elongated substantially rectangular frame comprising a pair of horizontally elongated girders connected at said one end by an end-tie and at the end opposite said one end by a center pivot member, said girders being sufficiently elongated to traverse the ground or floor area being serviced by said crane, said girders being sufficiently spaced from each other to provide said crane with structural stability and to provide a sufficiently open area between said girders to allow for the operation of said hoisting means.

13. The facility of claim 1 wherein said track is circular.

* * * * *